US010230194B2

(12) United States Patent
Akagi et al.

(10) Patent No.: US 10,230,194 B2
(45) Date of Patent: Mar. 12, 2019

(54) PROTECTIVE CAP

(71) Applicant: YAZAKI CORPORATION, Tokyo (JP)

(72) Inventors: Yosuke Akagi, Shizuoka (JP); Kaoru Matsumura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/724,291

(22) Filed: Oct. 4, 2017

(65) Prior Publication Data

US 2018/0102603 A1 Apr. 12, 2018

(30) Foreign Application Priority Data

Oct. 6, 2016 (JP) ..... 2016-197846

(51) Int. Cl.
*H01R 13/44* (2006.01)
*H01R 13/447* (2006.01)
(Continued)

(52) U.S. Cl.
CPC ..... *H01R 13/447* (2013.01); *H01R 13/443* (2013.01); *H01R 13/502* (2013.01);
(Continued)

(58) Field of Classification Search
CPC ..... H01R 13/5812; H01R 13/447; H01R 13/502; H01R 13/5205; H01R 13/62933; H01R 9/02; H01R 24/5812
See application file for complete search history.

(56) References Cited

U.S. PATENT DOCUMENTS 8,108,968 B2 * 2/2012 Pietryga ..... H02G 3/0468 16/2.1
8,814,598 B2 * 8/2014 Hein ..... H01R 13/5812 439/455
(Continued)

FOREIGN PATENT DOCUMENTS

CN 1238580 A 12/1999
CN 102860247 A 1/2013
(Continued)

OTHER PUBLICATIONS

The Japanese office action dated Sep. 4, 2018 in a counterpart Japanese Patent application.
Chinese office action dated Jan. 11, 2019 in a counterpart Chinese Patent application.

*Primary Examiner* — Jean F Duverne
(74) *Attorney, Agent, or Firm* — Metrolexis Law Group, PLLC

(57) ABSTRACT

A protective cap is used when a male inner housing to which male terminals and electric wires are attached is passed through a bellows-shaped tubular portion of a grommet. A male outer housing mounted on an annular seal portion of the grommet and the male inner housing accommodated in the male outer housing in a state where the male inner housing accommodates and holds the male terminals connected to the electric wires constitutes the connector. The protective cap includes a circular cap main body having an accommodating recess that accommodates tab portions of the male terminals protruding more than a front face of the male inner housing, at least a front side of the male inner housing being fitted into the accommodating recess. An outer diameter of the cap main body is smaller than an inner diameter of the bellows-shaped tubular portion.

8 Claims, 13 Drawing Sheets

(51) Int. Cl.

| | |
|---|---|
| ***H01R 13/52*** | (2006.01) |
| ***H01R 13/502*** | (2006.01) |
| ***H01R 13/443*** | (2006.01) |
| *H01R 13/629* | (2006.01) |
| *H01R 13/436* | (2006.01) |
| *H01R 13/516* | (2006.01) |

(52) U.S. Cl.
CPC ..... *H01R 13/5205* (2013.01); *H01R 13/4361* (2013.01); *H01R 13/516* (2013.01); *H01R 13/62933* (2013.01)

(56) References Cited

U.S. PATENT DOCUMENTS

| | | | | |
|---|---|---|---|---|
| 2004/0209523 | A1* | 10/2004 | Milner | H01R 24/64 439/676 |
| 2006/0060374 | A1* | 3/2006 | Trieb | H01R 9/032 174/113 A |
| 2015/0236432 | A1 | 8/2015 | Lin | |

FOREIGN PATENT DOCUMENTS

| | | | |
|---|---|---|---|
| JP | 2000-058190 | A | 2/2000 |
| JP | 2002-114113 | A | 4/2002 |
| JP | 2005-80443 | A | 3/2005 |
| JP | 2008-284964 | A | 11/2008 |
| JP | 2014-033563 | A | 2/2014 |

* cited by examiner

PROTECTIVE CAP

CROSS REFERENCE TO RELATED APPLICATIONS

This application claims the priority of Japanese Patent Application No. 2016-197846, filed on Oct. 6, 2016, the entire content of which are incorporated herein by reference.

BACKGROUND

Technical Field

The present invention relates to a protective cap used when a male inner housing of a connector to which a plurality of male terminals and a plurality of electric wires are attached is passed through a bellows-shaped tubular portion of a grommet.

Related Art

A protective cap is disclosed in JP 2000-58190 A as one of protective caps of this type.

As illustrated in FIGS. 13 and 14, this protective cap 1 is provided with a cap main body 2 and a cap side engagement portion 3. The cap main body 2 is formed of a synthetic resin and has the shape of a quadrangular tube. The cap main body 2 surrounds tab portions 7*a* of male terminals 7 protruding from a front end face 5*a* of a male connector housing 5 between a front portion of the protective cap 1 and a middle part of the protective cap 1. The cap side engagement portion 3 is provided on a rear side of the cap main body 2 and is used for engagement with the male connector housing 5.

The cap side engagement portion 3 comprises a tubular portion 3A and a pair of deflection engagement portions 3B, 3B. The tubular portion 3A is assembled on the front end face 5*a* of the male connector housing 5. The deflection engagement portions 3B, 3B extend from both right and left side wall surfaces of the tubular portion 3A. Retainer protection ribs 4 protrude upward and downward from a rear end part of the tubular portion 3A and prevent retainers 9 at a standby position from accidentally falling into a locking position.

The male connector housing 5 is a housing for a male connector of divided-type connectors. The male connector housing 5 accommodates the male terminals 7 in a plurality of cavities 6. The cavities 6 are formed in two, upper and lower, stages and in a right-left direction. A recessed retainer mounting port 8 communicating with the cavities 6 is provided at a middle part of the male connector housing 5. The male terminals 7 are subjected to double locking by the retainers 9 assembled in the retainer mounting port 8 and lances 6*a* formed in the cavities 6.

SUMMARY

Because the cap main body 2 of the protective cap 1 according to the related art is quadrangular tube-shaped, a number of parts of the shape of the protective cap 1 are stuck in a bellows-shaped tubular portion of a grommet when the male connector housing 5 is passed through the bellows-shaped tubular portion of the grommet in a state where the protective cap 1 is assembled on the front end face 5*a* of the male connector housing 5. As a result, damage may be done to the grommet during work for passing the male connector housing 5 through the grommet.

The present invention has been made to solve the above problem, and an objective of the present invention is to provide a protective cap with which work for passing a male inner housing of a connector to which a plurality of male terminals and a plurality of electric wires are attached through a bellows-shaped tubular portion of a grommet can be performed with ease and smoothness.

A protective cap according to an aspect of the present invention is used when a male inner housing to which a plurality of male terminals and a plurality of electric wires are attached is passed through a bellows-shaped tubular portion of a grommet in a case that a connector is to be used, a male outer housing mounted on an annular seal portion of the grommet and the male inner housing accommodated in an inner housing accommodating chamber in the male outer housing in a state where the male inner housing accommodates and holds the male terminals connected to the electric wires constitutes the connector. The protective cap includes a cap main body having circular shape and including an accommodating recessed portion configured to accommodate tab portions of the male terminals protruding more than a front face of the male inner housing, at least a front side of the male inner housing being fitted into the accommodating recessed portion. An outer diameter of the cap main body is smaller than an inner diameter of the bellows-shaped tubular portion of the grommet.

The male inner housing may include at least two divided inner housings, and the accommodating recessed portion may be formed to fit and accommodate at least one of the divided inner housings in a divided state.

A cutout may be formed in each of the divided inner housings and the cap main body for the electric wires to be avoided.

The accommodating recessed portion may have a size capable of fitting the divided inner housings in a divided state into single accommodating recessed portion.

As described above, the protective cap according to the aspect of the present invention includes the cap main body having circular shape and having the accommodating recessed portion accommodating the tab portions of the male terminals protruding more than the front face of the male inner housing, at least the front side of the male inner housing is fitted into the accommodating recessed portion, and the outer diameter of the cap main body is smaller than the inner diameter of the bellows-shaped tubular portion of the grommet. Accordingly, the protective cap can prevent the protective cap from being caught in the bellows-shaped tubular portion of the grommet when the male inner housing with a plurality of male terminals and electric wires is passed through the bellows-shaped tubular portion of the grommet, and work for passing the male inner housing through the grommet can be performed with ease and smoothness. As a result, damage to the grommet can be prevented.

In a case where the male inner housing includes at least two divided inner housings, the accommodating recessed portion may be formed to fit and accommodate at least one of the divided inner housings in a divided state. As a result, work for passing the divided inner housings through the grommet can be performed with ease and smoothness when the divided inner housings are passed through the bellows-shaped tubular portion of the grommet with the male terminals and the electric wires attached to the divided inner housings.

Since the cutout is formed in each of the divided inner housings and the cap main body for the electric wires to be avoided, a configuration can be achieved in which the bundle of the electric wires of a second male inner housing passed beforehand causes no hindrance when a first male inner housing is passed through the bellows-shaped tubular portion of the grommet.

Since the accommodating recessed portion has the size capable of fitting the divided inner housings in divided state with single accommodating recessed portion, the divided inner housings can be fitted with single protective cap, the number of required components can be reduced, and cost reduction can be achieved.

DETAILED DESCRIPTION

A detailed description will hereinafter be given of embodiments of the present invention with consultation of drawings.

Figure 1:
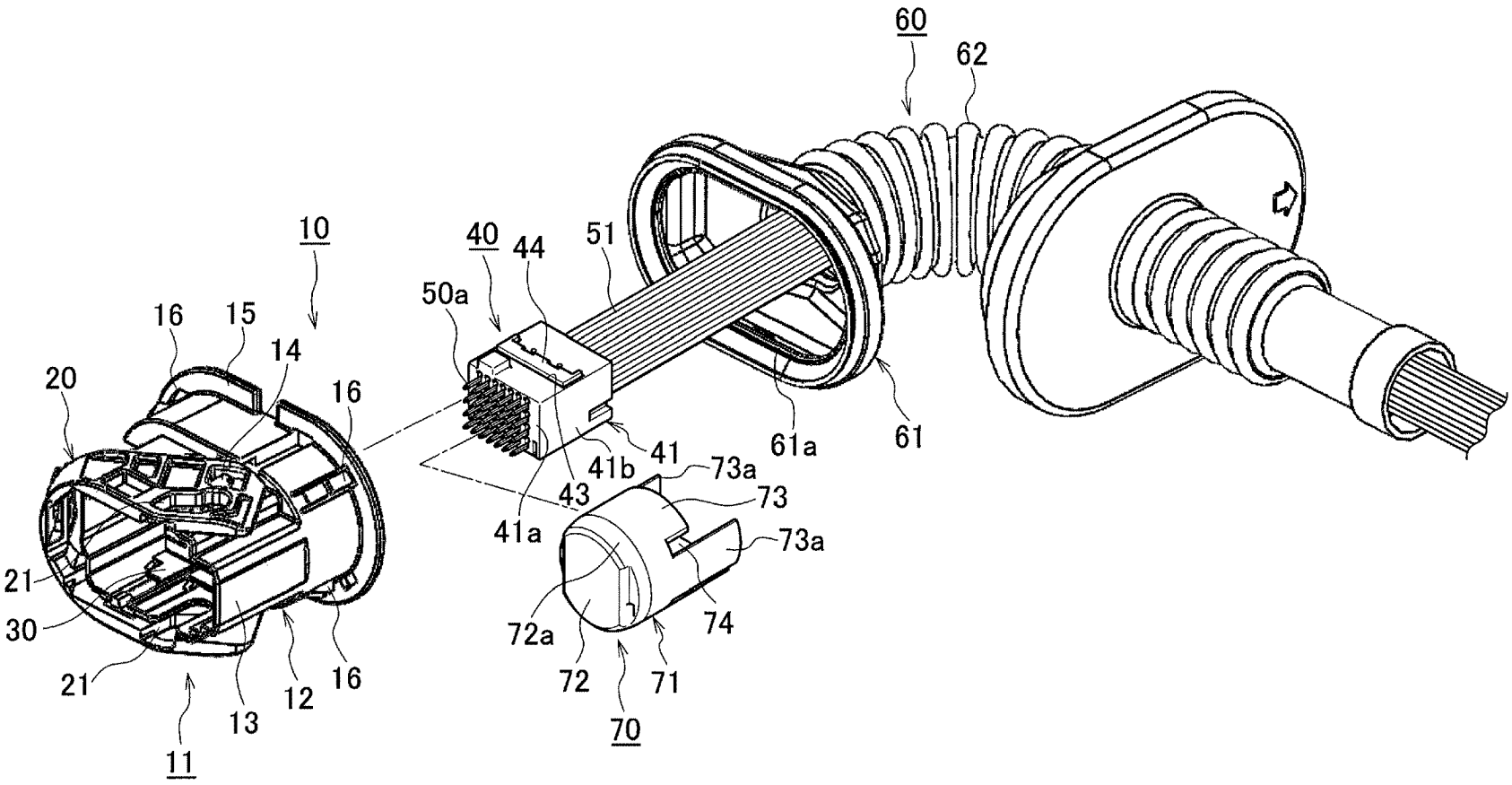
FIG. 1 is a perspective view illustrating a relationship among a protective cap, a grommet, and a male connector provided with a male inner housing according to a first embodiment of the present invention.
Figure 2:
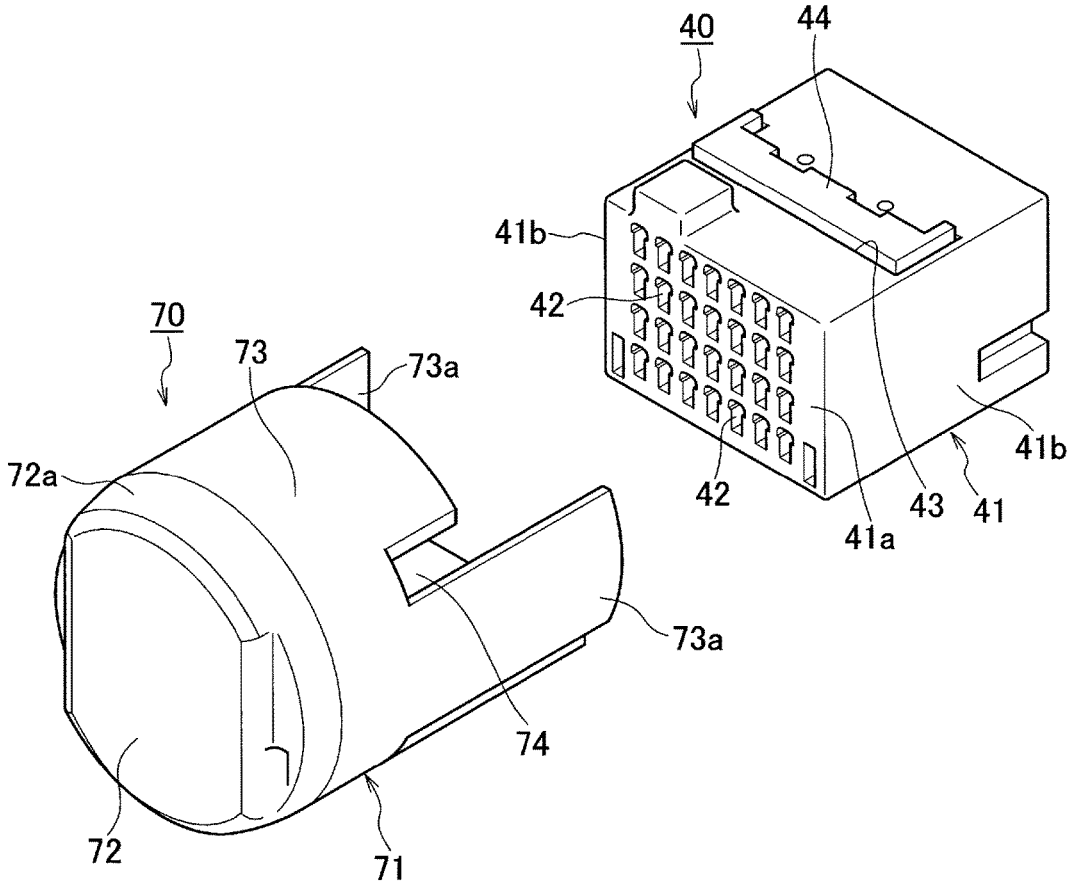
FIG. 2 is a perspective view illustrating a state where the male inner housing is yet to be installed in the protective cap according to the first embodiment.
Figure 3:
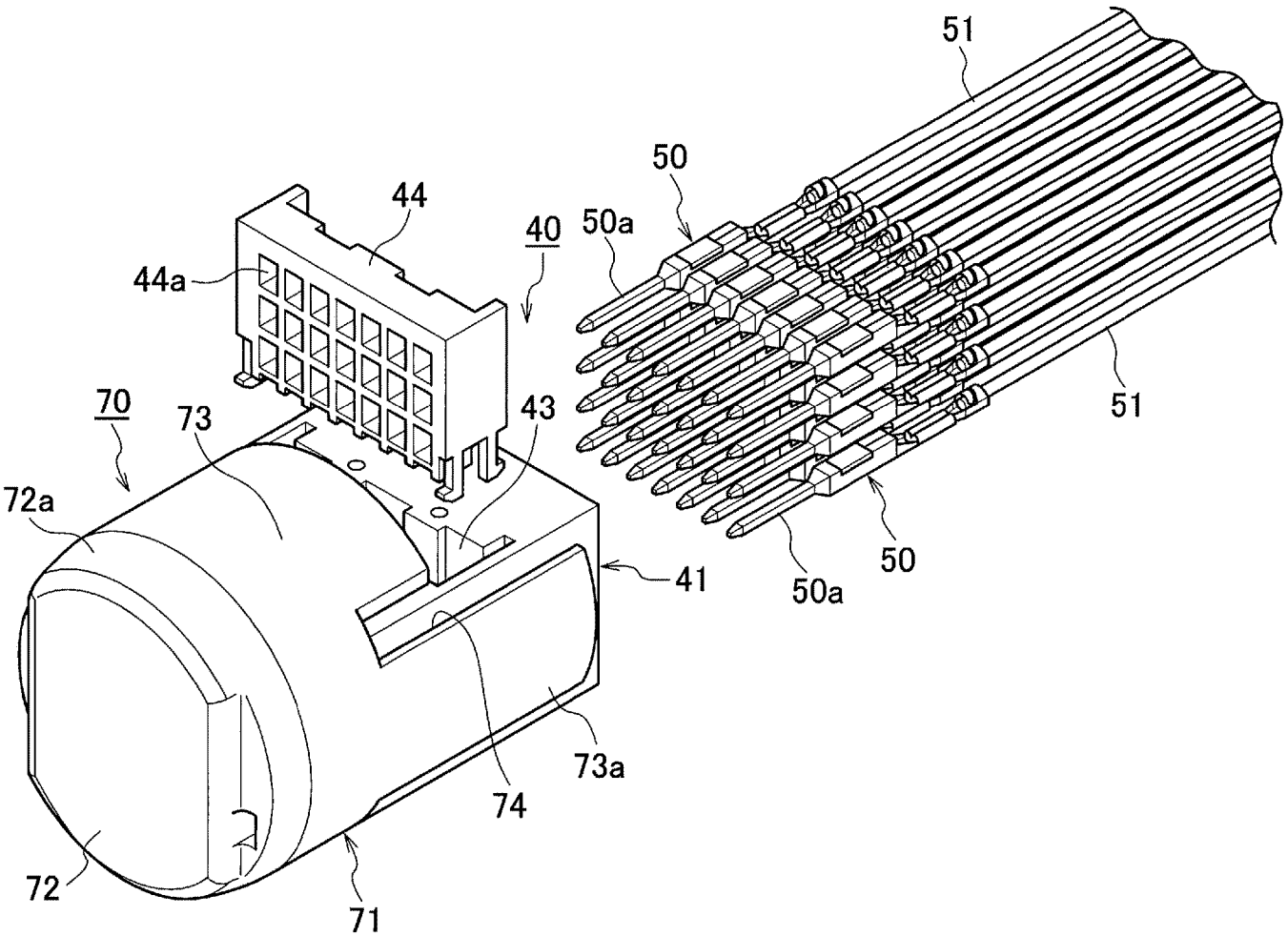
FIG. 3 is a perspective view illustrating a state where electric wire-attached male terminals are yet to be inserted into the male inner housing according to the first embodiment.
Figure 4:
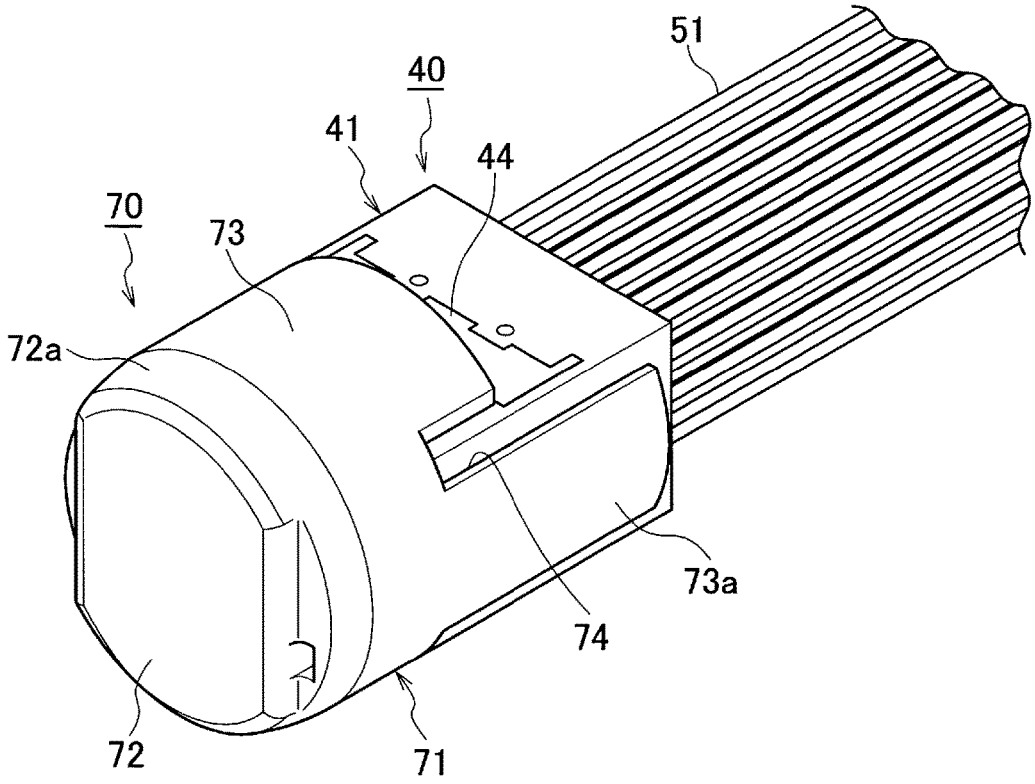
FIG. 4 is a perspective view illustrating a state where the electric wire-attached male terminals have been inserted into the male inner housing according to the first embodiment.
Figure 5A:
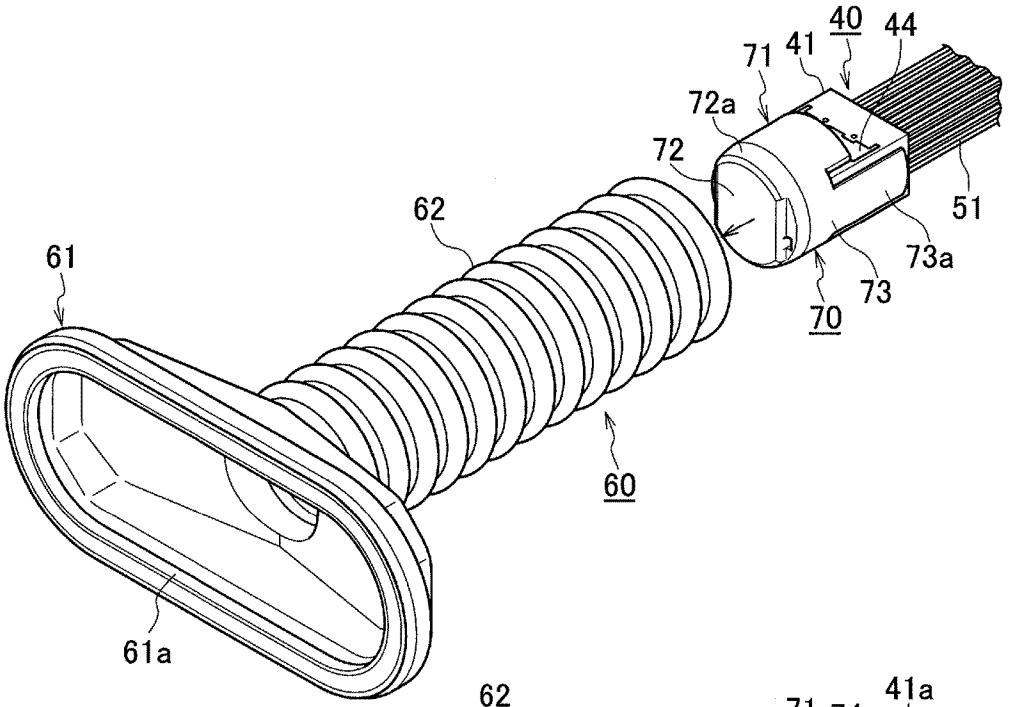
FIG. 5A is a perspective view illustrating a state where the protective cap-attached male inner housing is yet to be passed through a bellows-shaped tubular portion of the grommet according to the first embodiment.
Figure 5B:
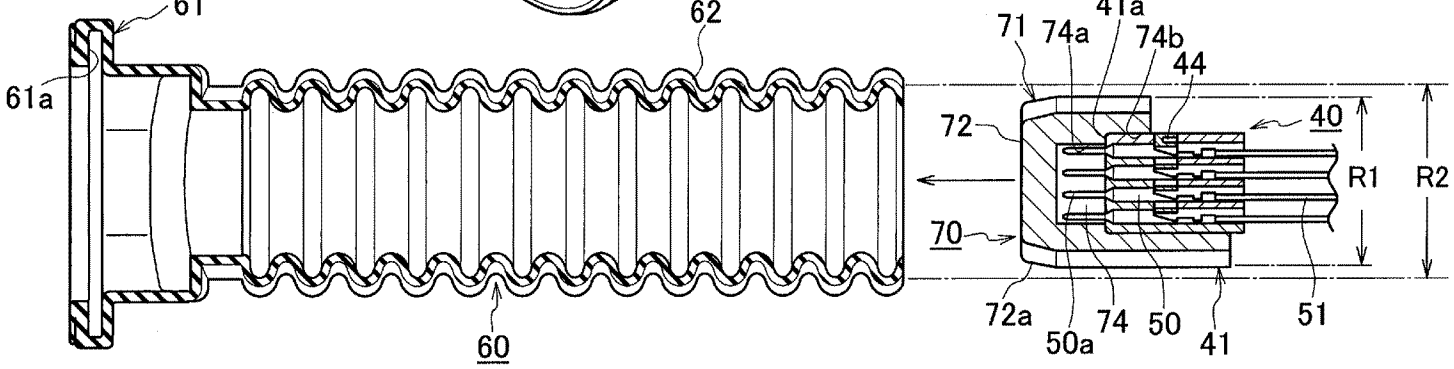
FIG. 5B is a sectional view illustrating the state where the protective cap-attached male inner housing is yet to be passed through the bellows-shaped tubular portion of the grommet.
Figure 6A:
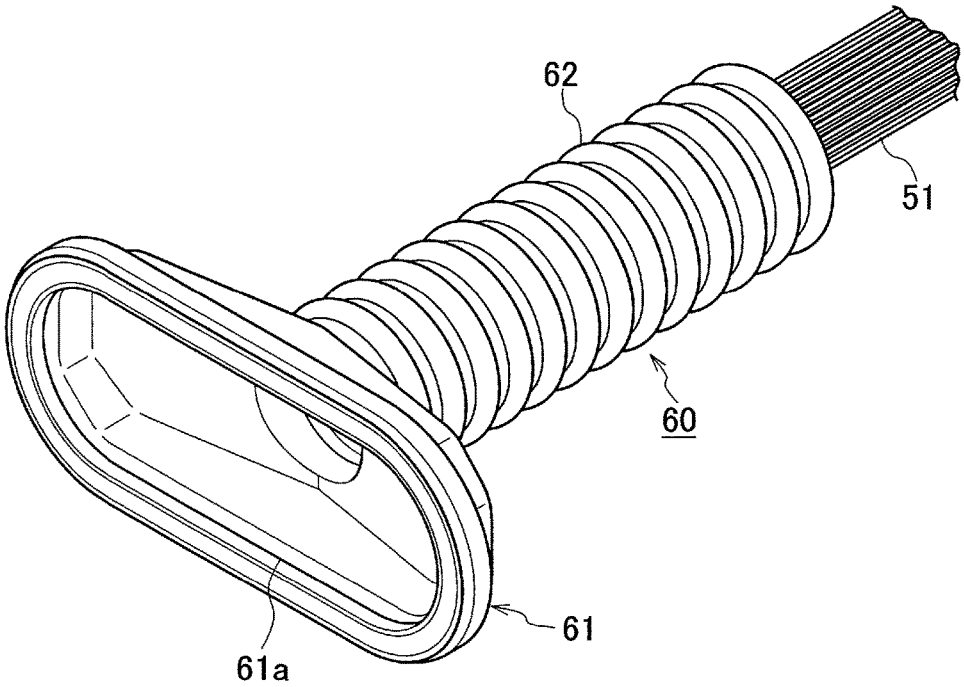
FIG. 6A is a perspective view illustrating a state where the protective cap-attached male inner housing is being passed through the bellows-shaped tubular portion of the grommet according to the first embodiment.
Figure 6B:
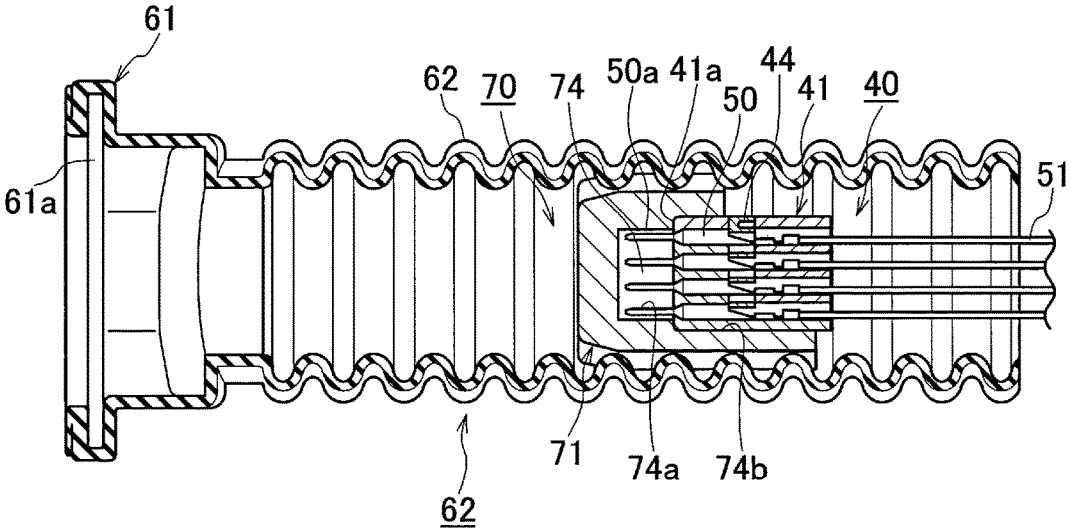
FIG. 6B is a sectional view illustrating the state where the protective cap-attached male inner housing is being passed through the bellows-shaped tubular portion of the grommet.
Figure 7A:
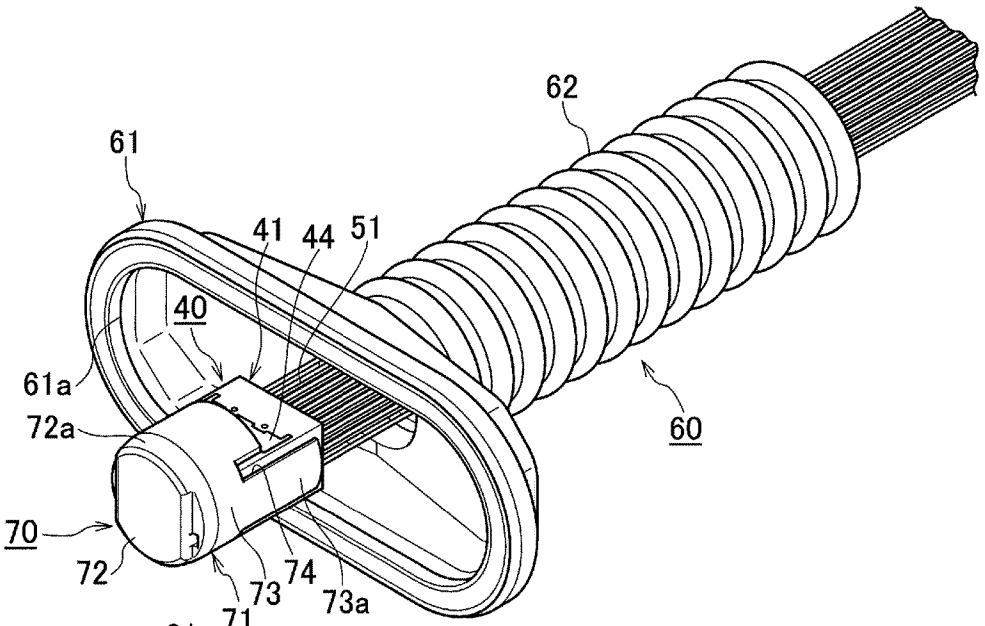
FIG. 7A is a perspective view illustrating a state where the protective cap-attached male inner housing has been passed through the bellows-shaped tubular portion of the grommet according to the first embodiment.
Figure 7B:
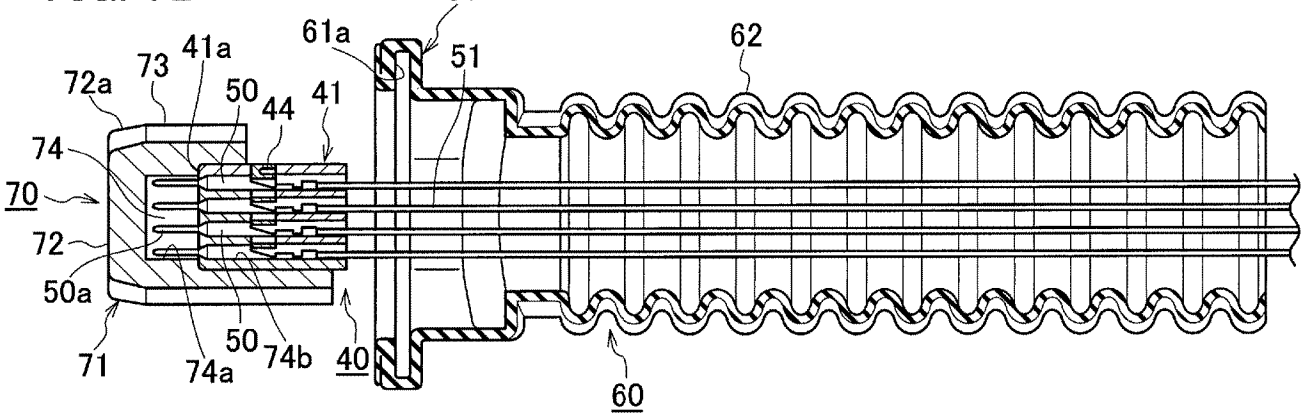
FIG. 7B is a sectional view illustrating the state where the protective cap-attached male inner housing has been passed through the bellows-shaped tubular portion of the grommet.
Figure 8:
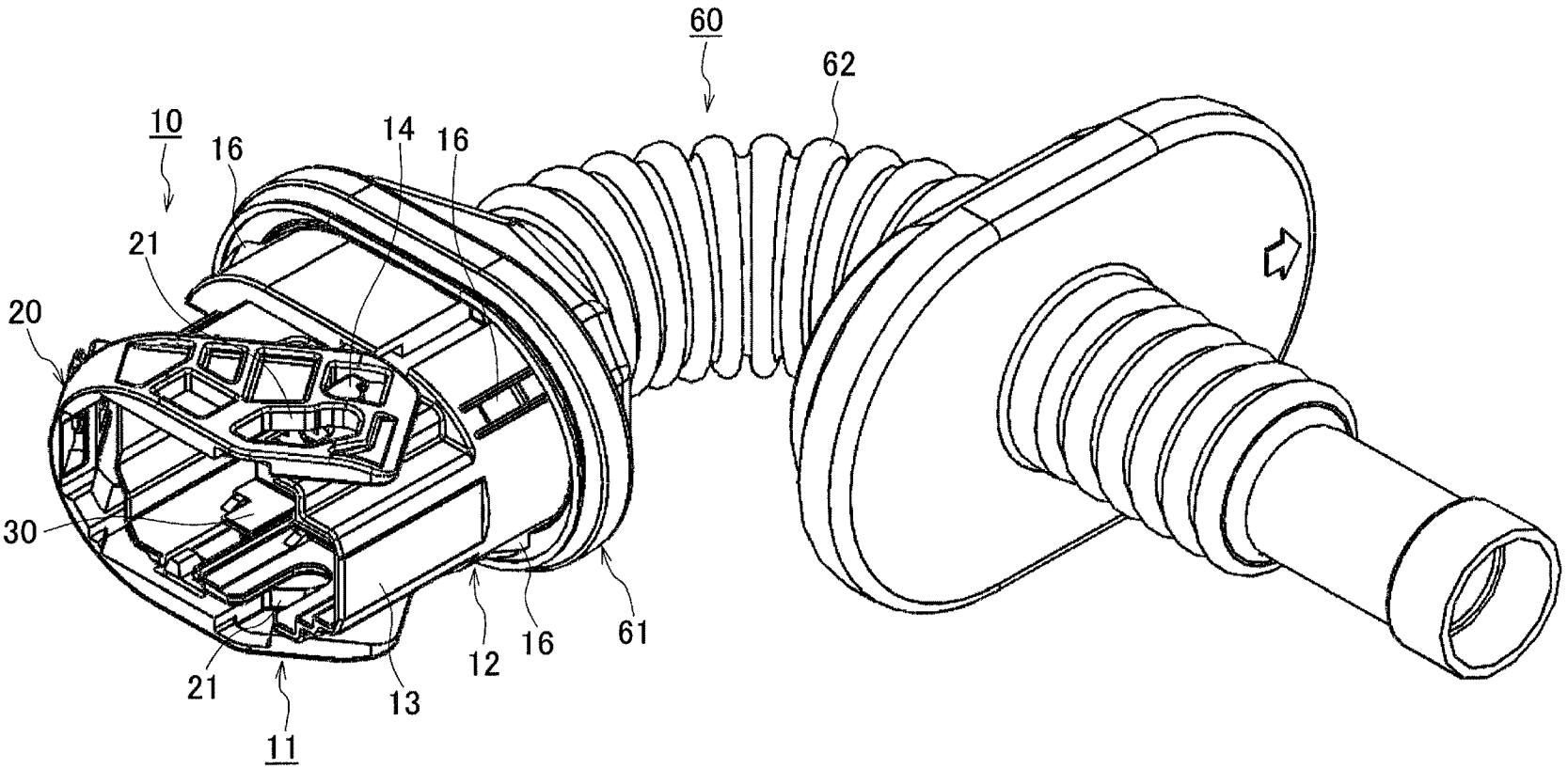
FIG. 8 is a perspective view illustrating a state where the male connector is mounted on the grommet.

FIG. 1 is a perspective view illustrating a relationship among a protective cap, a grommet, and a male connector provided with a male inner housing according to a first embodiment of the present invention. FIG. 2 is a perspective view illustrating a state where the male inner housing is yet to be installed in the protective cap. FIG. 3 is a perspective view illustrating a state where electric wire-attached male terminals are yet to be inserted into the male inner housing. FIG. 4 is a perspective view illustrating a state where the electric wire-attached male terminals have been inserted into the male inner housing. FIG. 5A is a perspective view illustrating a state where the protective cap-attached male inner housing is yet to be passed through a bellows-shaped tubular portion of the grommet. FIG. 5B is a sectional view illustrating the state where the protective cap-attached male inner housing is yet to be passed through the bellows-shaped tubular portion of the grommet. FIG. 6A is a perspective view illustrating a state where the protective cap-attached male inner housing is being passed through the bellows-shaped tubular portion of the grommet. FIG. 6B is a sectional view illustrating the state where the protective cap-attached male inner housing is being passed through the bellows-shaped tubular portion of the grommet. FIG. 7A is a perspective view illustrating a state where the protective cap-attached male inner housing has been passed through the bellows-shaped tubular portion of the grommet. FIG. 7B is a sectional view illustrating the state where the protective cap-attached male inner housing has been passed through the bellows-shaped tubular portion of the grommet. FIG. 8 is a perspective view illustrating a state where the male connector is mounted on the grommet.

As illustrated in FIGS. 1 to 8, a lever-type connector 10 comprises a male connector (connector) 11 and a female connector (not illustrated) that can be fitted into and separated from each other. The connector 10 is used as a connector for a front door of a car, for example. The male connector 11 is provided with a male outer housing 12 having a hood portion 13, a lever 20 rotatably supported via a spindle 14 in the male outer housing 12, a moving plate 30 positioning tab portions 50*a* of a plurality of male terminals 50 in the hood portion 13, and a male sub connector 40 having a male inner housing 41 that is accommodated in an inner housing accommodating chamber (sub connector accommodating chamber, not illustrated) which is formed in the male outer housing 12. A protective cap 70 is used when the male inner housing 41 to which the male terminals 50 and electric wires 51 are attached is passed through a bellows-shaped cylindrical portion (tubular portion) 62 of a rubber grommet 60. The female connector is moved to a back side and an opening side in the hood portion 13 along with the moving plate 30 and is fitted into and separated from the male outer housing 12 by the lever 20 being operated in a state where a cam follower of the female connector (not illustrated) is engaged with a cam groove 21 of the lever 20.

A flange portion 15 that has the shape of an annular plate is formed integrally with and protrudes from the outer periphery of a rear end of the male outer housing 12. A recessed groove 61*a* of an annular seal portion 61 on a front side of the rubber grommet 60 is fitted into the annular flange portion 15. A pair of upper locking projections 16 and a pair of lower locking projections 16 are formed integrally with and protrude from the outer periphery of the rear end of the male outer housing 12 as well. Once the male outer housing 12 is passed from the door side through a mounting hole in a panel of the car (not illustrated), tips of the upper and lower locking projections 16 and 16 on the male outer housing 12 are locked on a body side surface around the mounting hole in the panel. As a result, the male connector 11 is installed in the mounting hole in the panel in a state where the male connector 11 is sealed via the annular seal portion 61 on the front side of the grommet 60.

As illustrated in FIGS. 2 to 4, the male sub connector 40 has the male inner housing 41, and the male inner housing 41 is formed of a synthetic resin and has the shape of a substantially angular block. The male sub connector 40 is inserted from behind into and accommodated in the inner housing accommodating chamber (sub connector accommodating chamber, not illustrated) in the male outer housing 12. A plurality of cavities 42 penetrates the male inner housing 41 in a front-rear direction, and the cavities 42 are capable of accommodating the male terminals 50 connected to terminals of the electric wires 51. Flexible lances (not illustrated) retaining the male terminals 50 are formed on inner walls of the cavities 42. In addition, a spacer installation hole 43 communicating with each of the cavities 42 is formed as an opening in an upper surface of the male inner housing 41. A spacer 44 is inserted from above into the spacer installation hole 43. The male terminals 50 are subjected to double locking by the lances (not illustrated) and the spacer 44 inserted with a normal depth into the spacer installation hole 43. A plurality of terminal accommodating holes 44*a* is formed at positions in the spacer 44 that correspond to the cavities 42 in the male inner housing 41.

As illustrated in FIGS. 1 to 7B, the protective cap 70 used when the male inner housing 41 to which the male terminals 50 and the electric wires 51 are attached is passed through the bellows-shaped cylindrical portion 62 of the grommet 60 is provided with a cap main body 71 having circular shape. An accommodating recessed portion 74 is formed in the cap main body 71. The accommodating recessed portion 74 accommodates the tab portions 50*a* of the male terminals 50 protruding more than a front face 41*a* of the male inner housing 41, and a front side of the male inner housing 41 is fitted into the accommodating recessed portion 74. The cap main body 71 is formed of a synthetic resin.

As illustrated in FIGS. 2 to 5B, the cap main body 71 has a disc-shaped front portion 72, the front portion 72 has a conical surface 72*a* formed at its outside peripheral edge, and a rear portion 73 of the cap main body 71 is formed in a cylindrical shape. The stepped and rectangular accommodating recessed portion 74 is formed in the rear portion 73. The accommodating recessed portion 74 accommodates the tab portions 50*a* of the male terminals 50 protruding more than the front face 41*a* of the male inner housing 41 and has a size allowing the front side of the male inner housing 41 to be fitted into the accommodating recessed portion 74. In other words, the tab portions 50*a* of the male terminals 50 protruding more than the front face 41*a* of the male inner housing 41 are accommodated in a front portion 74*a* of the accommodating recessed portion 74, and the front side of the male inner housing 41 is fitted into a rear portion 74*b* of the accommodating recessed portion 74.

As illustrated in FIG. 5B, an outer diameter R1 of the disc-shaped front portion 72 of the cap main body 71 is smaller than an inner diameter R2 of the bellows-shaped cylindrical portion 62 of the grommet 60 (R1<R2). In addition, both side portions 73*a* and 73*a* of the rear portion 73 of the cap main body 71 extend more than the rear portion 73, for both side surfaces 41*b* and 41*b* of the male inner housing 41 to be held, with outer peripheral surfaces formed integrally with and protruding in the shape of an arc surface from the rear portion 73.

According to the protective cap 70 of the above-described embodiment, the front side of the male inner housing 41 is fitted into the rear portion 74*b* of the accommodating recessed portion 74 of the cap main body 71 of the protective cap 70, as illustrated in FIGS. 2 and 3, before the male inner housing 41 of the male connector 11 to which the male terminals 50 and the electric wires 51 are attached is passed through the bellows-shaped cylindrical portion 62 of the grommet 60. Subsequently, the male terminals 50 are subjected to the double locking by the male terminals 50 being inserted into the cavities 42 in the male inner housing 41 and the spacer 44 being installed into the spacer installation hole 43 as illustrated in FIG. 4. By the male terminals 50 being inserted into the male inner housing 41 after the male inner housing 41 is installed in the protective cap 70 as described above, the tab portions 50*a* of the male terminals 50 can be accommodated in the front portion 74*a* of the accommodating recessed portion 74 of the cap main body 71 without deformation. As a result, bending of the tab portions 50*a* of the male terminals 50 can be reliably prevented when the male terminals 50 to which the electric wires 51 are attached are assembled in the male inner housing 41.

In this state, the male inner housing 41 of the male connector 11 to which the male terminals 50 and the electric wires 51 are attached is passed through the bellows-shaped cylindrical portion 62 of the grommet 60 as illustrated in FIGS. 5A to 7B. At this time, the protective cap 70 is not stuck in the bellows-shaped cylindrical portion 62 of the grommet 60 as illustrated in FIG. 6B because the cap main body 71 of the protective cap 70 is circular in shape, the conical surface 72*a* is formed at the outside peripheral edge of the front portion 72, and the outer diameter R1 of the cap main body 71 is smaller than the inner diameter R2 of the bellows-shaped cylindrical portion 62 of the grommet 60. As a result, work for passing the male inner housing 41 through the grommet can be performed with ease and smoothness, and damage to the grommet 60 can be prevented.

Subsequently, the protective cap 70 is removed from the male inner housing 41 to which the male terminals 50 and the electric wires 51 are attached with the male inner housing 41 exposed to the outside from the annular seal portion 61 on the front side of the grommet 60 through the bellows-shaped cylindrical portion 62 of the grommet 60 as illustrated in FIGS. 7A and 7B. With the protective cap 70 removed, the male inner housing 41 is mounted on the male outer housing 12 of the male connector 11. Then, the annular flange portion 15 of the male outer housing 12 is fitted into the recessed groove 61*a* of the annular seal portion 61 of the grommet 60. As a result of the fitting, the male connector 11 is mounted on the grommet 60 as illustrated in FIG. 8.

Figure 9:
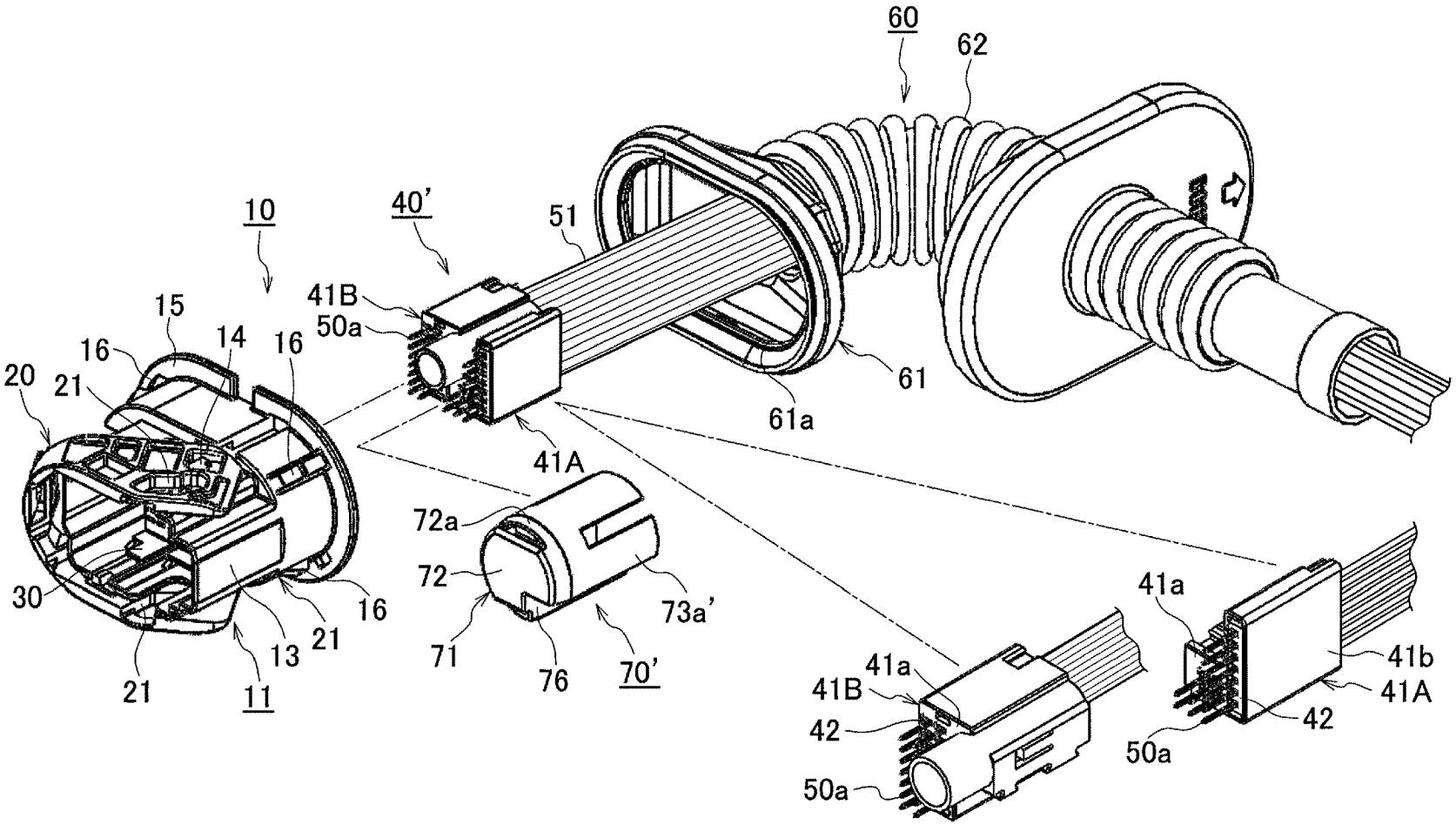
FIG. 9 is a perspective view illustrating a relationship among a protective cap, a grommet, and a male connector provided with divided-type male inner housings according to a second embodiment of the present invention.
Figure 10A:
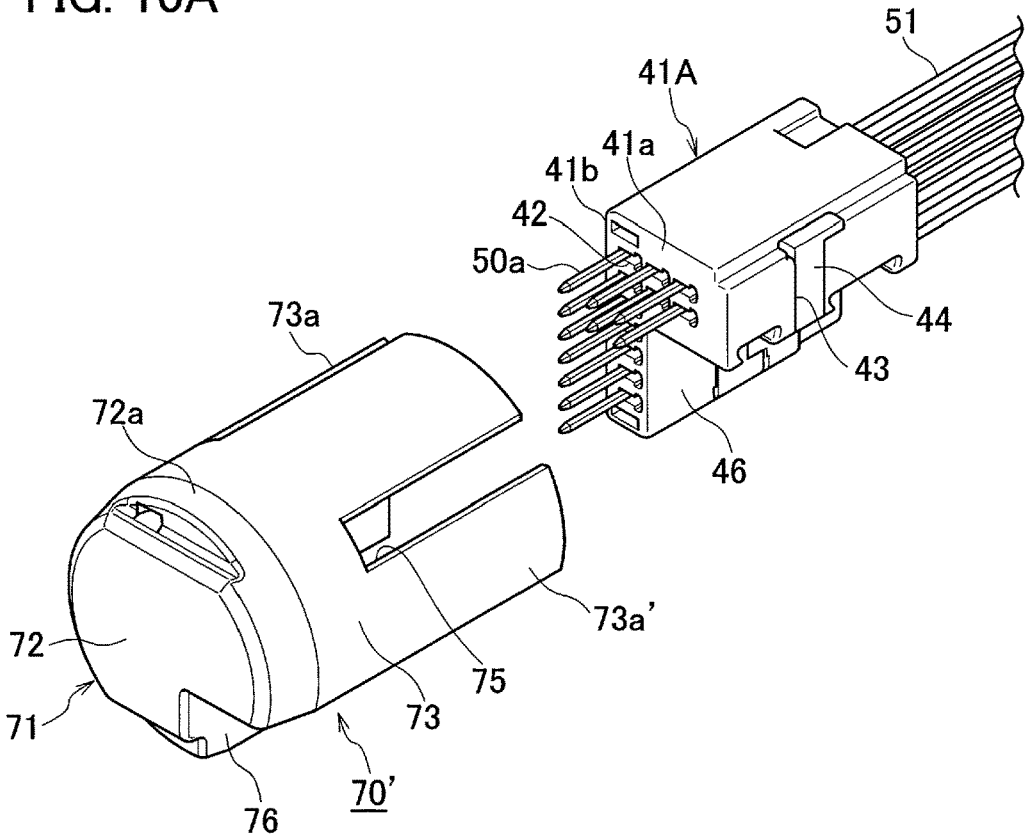
FIG. 10A is a perspective view illustrating a state where a male terminal- and electric wire-attached first male inner housing is yet to be assembled in the protective cap according to the second embodiment.
Figure 10B:
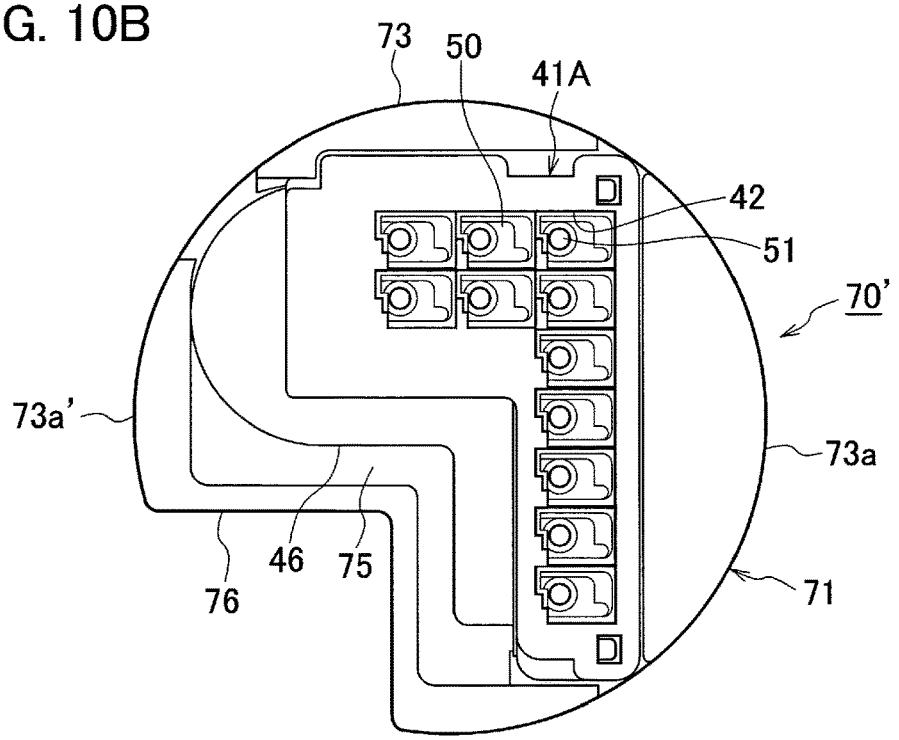
FIG. 10B is a rear view illustrating the state where the male terminal- and electric wire-attached first male inner housing is yet to be assembled in the protective cap.
Figure 11A:
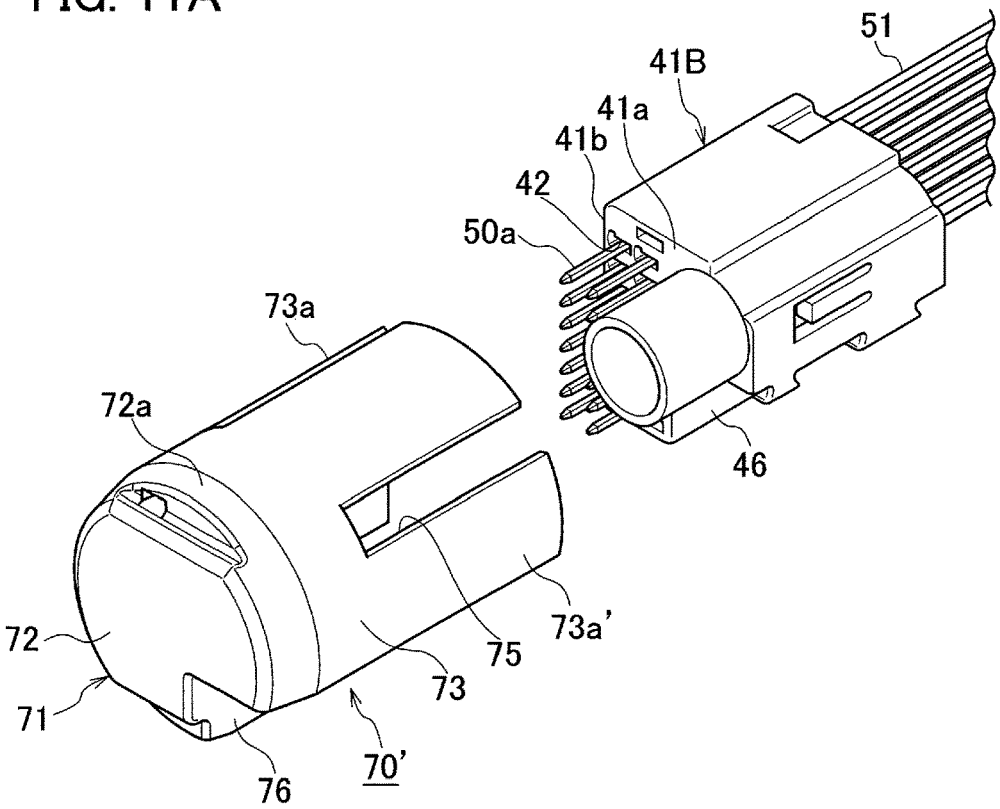
FIG. 11A is a perspective view illustrating a state where a male terminal- and electric wire-attached second male inner housing is yet to be assembled in the protective cap according to the second embodiment.
Figure 11B:
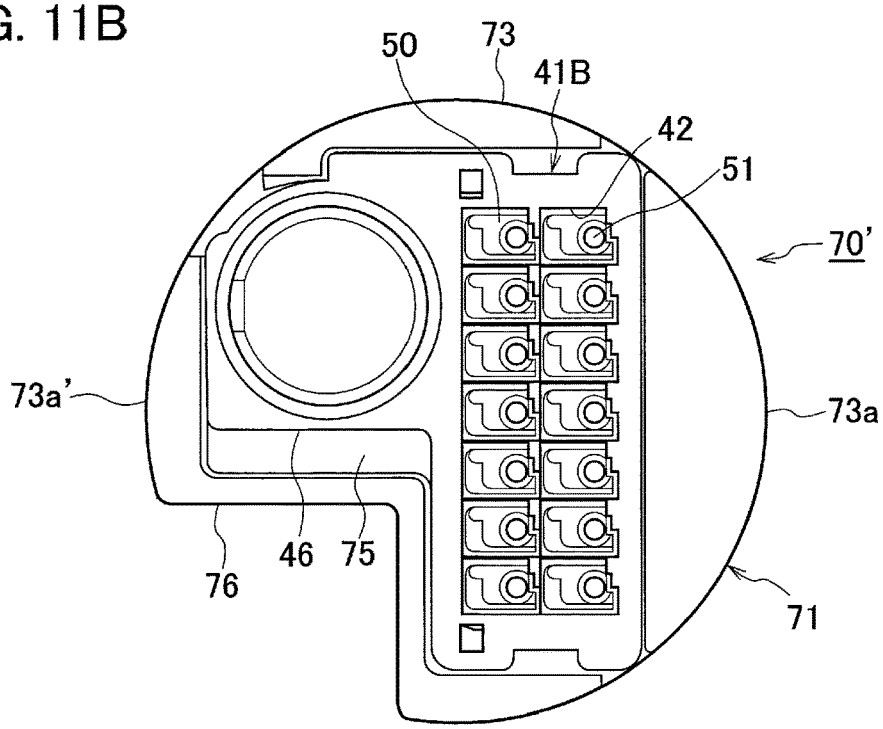
FIG. 11B is a rear view illustrating the state where the male terminal- and electric wire-attached second male inner housing is yet to be assembled in the protective cap.
Figure 12:
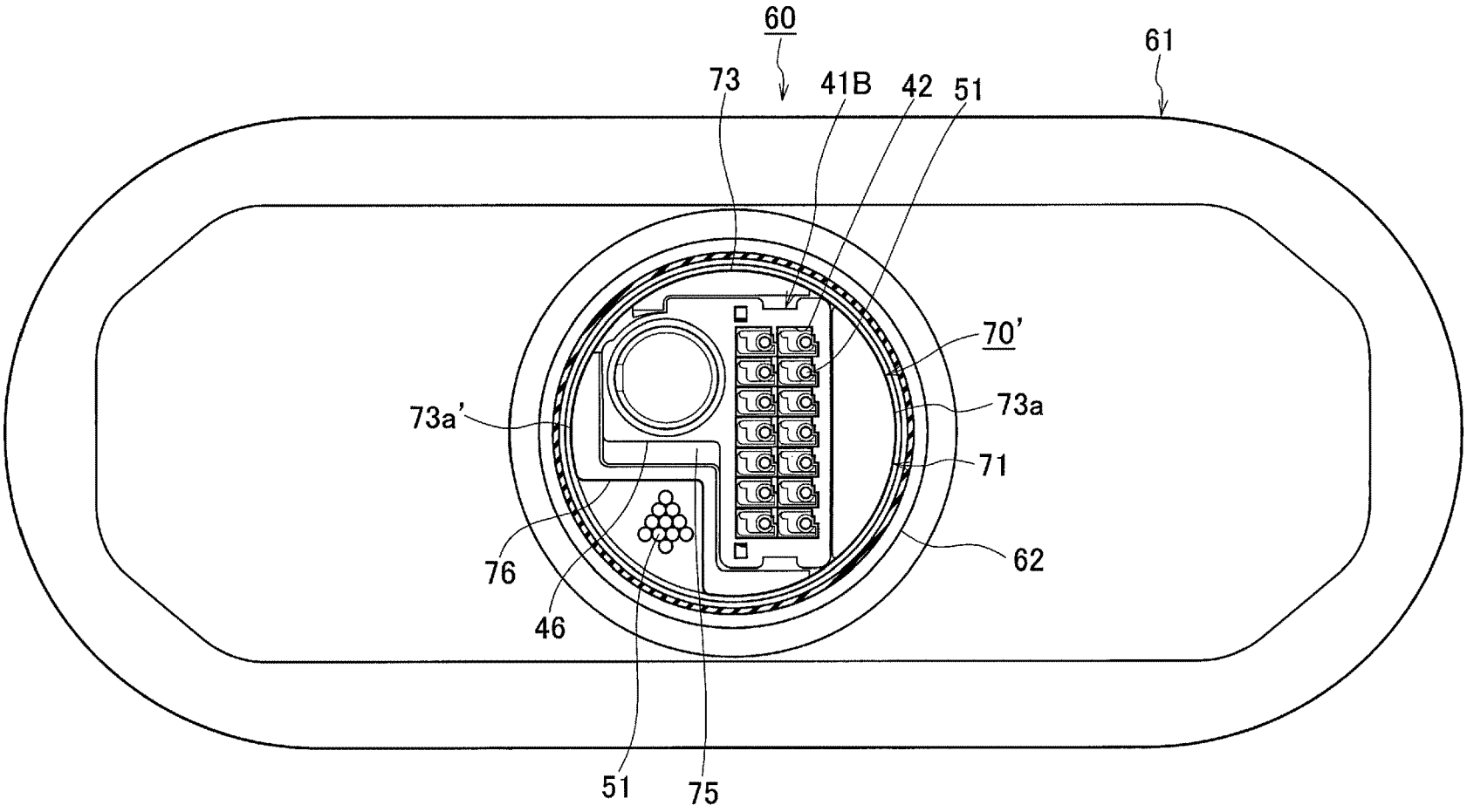
FIG. 12 is a partial rear sectional view illustrating a state where the protective cap-attached second male inner housing has been passed through a bellows-shaped tubular portion of the grommet.
Figure 13:
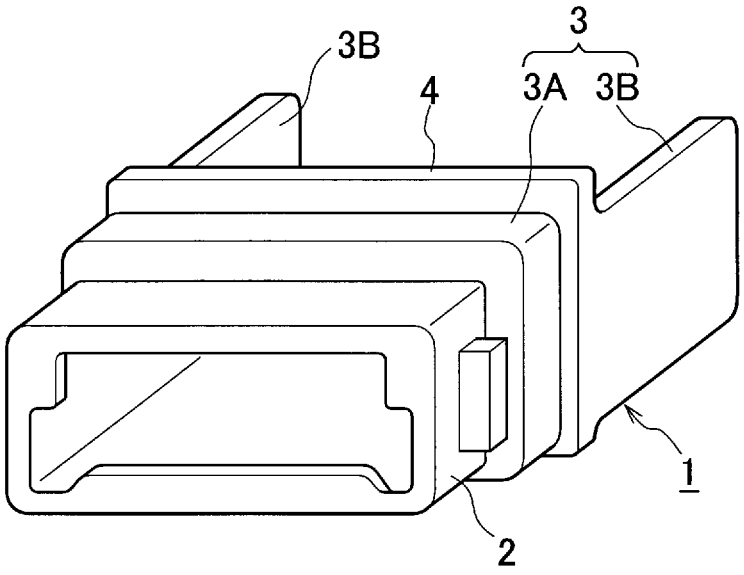
FIG. 13 is a perspective view of a protective cap used for a connector according to a conventional example.
Figure 14:
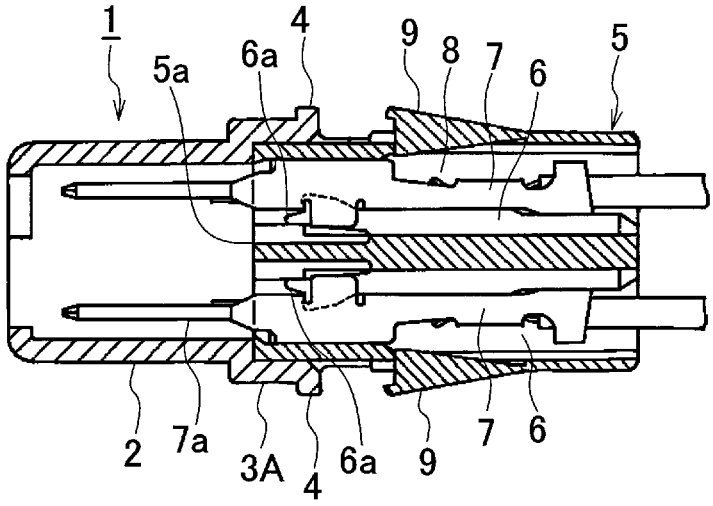
FIG. 14 is a side sectional view illustrating a state where the protective cap is assembled in the connector according to the conventional example.

FIG. 9 is a perspective view illustrating a relationship among a protective cap, a grommet, and a male connector provided with divided-type male inner housings according to a second embodiment of the present invention. FIG. 10A is a perspective view illustrating a state where a male terminal- and electric wire-attached first male inner housing is yet to be fitted into the protective cap. FIG. 10B is a rear view illustrating the state where the male terminal- and electric wire-attached first male inner housing is yet to be fitted into the protective cap. FIG. 11A is a perspective view illustrating a state where a male terminal- and electric wire-attached second male inner housing is yet to be fitted into the protective cap. FIG. 11B is a rear view illustrating the state where the male terminal- and electric wire-attached second male inner housing is yet to be fitted into the protective cap. FIG. 12 is a partial rear sectional view illustrating a state where the protective cap-attached second male inner housing has been passed through a bellows-shaped tubular portion of the grommet.

In the second embodiment, a male sub connector 40', passed through a bellows-shaped cylindrical portion (tubular portion) 62 of a grommet 60 with a plurality of male terminals 50 and a plurality of electric wires 51 attached to the male sub connector 40', comprises two separate male inner housings (divided inner housings) 41A and 41B as illustrated in FIG. 9, and the second male inner housing 41B is passed through the bellows-shaped cylindrical portion 62 of the grommet 60 as illustrated in FIG. 12 after the first male inner housing 41A is passed through the bellows-shaped cylindrical portion 62 of the grommet 60 (the electric wires 51 illustrated in FIG. 12 are the electric wires of only the first male inner housing 41A passed beforehand). A protective cap 70' is used when each of the male inner housings 41A and 41B in a divided state is passed through the bellows-shaped cylindrical portion 62 of the grommet 60. The first male inner housing 41A may be passed through the bellows-shaped cylindrical portion 62 of the grommet 60 after the second male inner housing 41B is passed through the bellows-shaped cylindrical portion 62 of the grommet 60 as well.

As is the case with the protective cap 70 according to the first embodiment, the protective cap 70' is provided with a cap main body 71 having the grommet 60 is provided with a cap main body 71 having circular shape, an accommodating recessed portion 75 is formed in the cap main body 71, the accommodating recessed portion 75 accommodates tab portions 50*a* of the male terminals 50 protruding more than a front face 41*a* of each of the male inner housings 41A and 41B, front sides of the male inner housings 41A and 41B are fitted into the accommodating recessed portion 75, and the cap main body 71 is formed of a synthetic resin.

The cap main body 71 has a disc-shaped front portion 72, the front portion 72 has a conical surface 72*a* formed at its outside peripheral edge, and a rear portion 73 of the cap main body 71 is formed in a cylindrical shape. The disc-shaped front portion 72 of the cap main body 71 has an outer diameter smaller than the inner diameter of the bellows-shaped cylindrical portion 62 of the grommet 60. The accommodating recessed portion 75 is formed in the rear portion 73 of the cap main body 71. The accommodating recessed portion 75 accommodates the tab portions 50*a* of the male terminals 50 protruding more than the front face 41*a* of each of the male inner housings 41A and 41B, has a size allowing the front sides of the male inner housings 41A and 41B to be fitted into the accommodating recessed portion 75, and has an L-shaped back face. In other words, the accommodating recessed portion 75 of the cap main body 71 has a size that allows both the male inner housings 41A and 41B in divided state to be fitted into single accommodating recessed portion 75. The outer diameter of the disc-shaped front portion 72 of the cap main body 71 is smaller than the inner diameter of the bellows-shaped cylindrical portion 62 of the grommet 60.

A cutout 46 is formed in the male inner housings 41A and 41B and a cutout 76 is formed in the cap main body 71 for the bundle of the electric wires 51 (wire harness) of the male inner housings 41A and 41B passed beforehand to be avoided. In addition, both side portions 73*a* and 73*a'* of the rear portion 73 of the cap main body 71 extend more than, are formed integrally with, and protrude from the rear portion 73 for both side surfaces 41*b* and 41*b* of the male inner housing 41 to be held. The first side portion 73*a* as one of the side portions 73*a* and 73*a'* has an outer peripheral surface integrally formed and protruding in the shape of an arc surface. The second side portion 73*a'* as the other one of the side portions 73*a* and 73*a'* has an upper outer peripheral surface that has the shape of an arc surface and a lower outer peripheral surface that has the form of an L-shaped groove for the cutout 76 to be formed.

According to the protective cap 70' of the second embodiment, the first male inner housing 41A in a divided state is fitted into the accommodating recessed portion 75 of the cap main body 71 of the protective cap 70' as illustrated in FIG. 10B. Then, the first male inner housing 41A to which the male terminals 50 and the electric wires 51 are attached is passed through the bellows-shaped cylindrical portion 62 of the grommet 60 before the second male inner housing 41B is passed through the bellows-shaped cylindrical portion 62 of the grommet 60. At this time, the protective cap 70' is not stuck in the bellows-shaped cylindrical portion 62 of the grommet 60 as is the case with the protective cap 70 according to the first embodiment because the cap main body 71 of the protective cap 70' is circular in shape, the conical surface 72*a* is formed at the outside peripheral edge of the front portion 72, and the outer diameter of the cap main body 71 is smaller than the inner diameter of the bellows-shaped cylindrical portion 62 of the grommet 60. As a result, work for passing the first male inner housing 41A through the grommet can be performed with ease and smoothness, and damage to the grommet 60 can be prevented.

Subsequently, the first male inner housing 41A is passed through the bellows-shaped cylindrical portion 62 of the grommet 60, and then the protective cap 70' is removed from the first male inner housing 41A. Then, the second male inner housing 41B is passed through the bellows-shaped cylindrical portion 62 of the grommet 60 after the second male inner housing 41B is fitted into the accommodating recessed portion 75 of the cap main body 71. At this time, the second male inner housing 41B and the cap main body 71 have the respective cutouts 46 and 76 forming spaces for the bundle of the electric wires 51 of the first male inner housing 41A passed beforehand to be avoided, and thus the bundle of the electric wires 51 of the first male inner housing 41A passed beforehand causes no hindrance when the second male inner housing 41B is passed through the bellows-shaped cylindrical portion 62 of the grommet 60 as illustrated in FIG. 12.

The male inner housings 41A and 41B in divided state can be fitted into the single accommodating recessed portion 75 of the cap main body 71 of the protective cap 70'. Accordingly, the number of required components can be reduced and cost reduction can be achieved to that extent.

The protective cap 70' is removed from the second male inner housing 41B, and then the male sub connector 40' is mounted on the male outer housing 12 of the male connector 11 in a state where the two male inner housings 41A and 41B are united, as illustrated in FIG. 9. Then, the annular flange portion 15 of the male outer housing 12 is fitted into the recessed groove 61*a* of the annular seal portion 61 of the grommet 60. As a result of the fitting, the male connector 11 is mounted on the grommet 60.

Although each of the first and second embodiments has been described with regard to a case where the bellows-shaped tubular portion of the grommet is cylindrical in shape, it is a matter of course that the description is also applicable to a case where the bellows-shaped tubular portion is not cylindrical in shape. Although the second embodiment has been described with regard to a case where the male inner housing is divided into two, it is a matter of course that the description is also applicable to a case where the male inner housing is divided into three or more.

What is claimed is:

1. A protective cap used when a male inner housing to which a plurality of male terminals and a plurality of electric wires are attached is passed through a bellows-shaped tubular portion of a grommet in a case that a connector is to be used, a male outer housing mounted on an annular seal portion of the grommet and the male inner housing accommodated in an inner housing accommodating chamber in the male outer housing in a state where the male inner housing accommodates and holds the male terminals connected to the electric wires constitutes the connector, the protective cap comprising:

a cap main body having circular shape and including an accommodating recessed portion configured to accommodate tab portions of the male terminals protruding more than a front face of the male inner housing, at least a front side of the male inner housing being fitted into the accommodating recessed portion, wherein an outer diameter of the cap main body is smaller than an inner diameter of the bellows-shaped tubular portion of the grommet, and the cap main body comprises a disc-shaped front portion that covers the male terminals protruding more than the front face of the male inner housing.

2. The protective cap according to claim 1, wherein the male inner housing includes at least two divided inner housings, and the accommodating recessed portion is formed to fit and accommodate at least one of the divided inner housings in a divided state.

3. The protective cap according to claim 2, wherein a cutout is formed in each of the divided inner housings and the cap main body for the electric wires to be avoided.

4. The protective cap according to claim 2, wherein the accommodating recessed portion comprises a single accommodating recessed portion having a size capable of fitting the divided inner housings in divided state into the single accommodating recessed portion.

5. The protective cap according to claim 4, wherein the cap main body comprises a rear portion, the disc-shaped front portion comprises a conical surface formed at an outside peripheral edge thereof, the rear portion of the cap main body is formed in a cylindrical shape, and the accommodating recessed portion has an L-shaped back face that allows the divided inner housings to be fitted into the single accommodating recessed portion.

6. The protective cap according to claim 1, wherein the cap main body further comprises a rear portion the disc-shaped front portion comprises a conical surface formed at an outside peripheral edge thereof, and the rear portion of the cap main body is formed in a cylindrical shape.

7. The protective cap according to claim 6, wherein the rear portion comprises side portions, and the side portions extend more than the rear portion.

8. The protective cap according to claim 1, wherein the protective cap is removed from the male inner housing when the male inner housing to which the plurality of male terminals and the plurality of electric wires are attached is passed through the bellows-shaped tubular portion of the grommet in the case that the connector is to be used.

* * * * *